US005294761A

United States Patent [19]

Okutomi et al.

[11] Patent Number: 5,294,761

[45] Date of Patent: Mar. 15, 1994

[54] VACUUM INTERRUPTER

[75] Inventors: Tsutomu Okutomi, Kanagawa; Tsuneyo Seki, Tokyo; Hideo Suzuki, Kanagawa; Shinzo Sugai, Kanagawa; Kazuya Tujimoto, Kanagawa; Hiroshi Watanabe, Tokyo; Kiyoshi Osabe, Tokyo; Atsushi Yamamoto, Tokyo; Hiroshi Yamazoe, Tokyo, all of Japan

[73] Assignee: Kabushiki Kaisha Toshiba, Kawasaki, Japan

[21] Appl. No.: 979,280

[22] Filed: Nov. 20, 1992

[30] Foreign Application Priority Data

Nov. 11, 1991 [JP] Japan ..... 3-307879

[51] Int. Cl.[5] ..... H01H 33/53; H01H 33/00

[52] U.S. Cl. ..... 200/144 B; 200/144 R

[58] Field of Search ..... 200/144 R, 151, 144 A, 200/144 B, 144 C, 145, 148 R, 148 A, 148 B, 148 F, 149 R, 149 A, 149 B, 150 R, 150 J, 151

[56] References Cited

U.S. PATENT DOCUMENTS 4,624,706 11/1986 Badia ..... 75/246
4,933,518 6/1990 Yin ..... 200/144 B

FOREIGN PATENT DOCUMENTS 0039611 11/1981 European Pat. Off. .
0129080 12/1984 European Pat. Off. .
0131798 1/1985 European Pat. Off. .
0329228 2/1991 Japan ..... H01H 33/66

OTHER PUBLICATIONS

Patent Abstracts of Japan, vol. 13, No. 396 & JP-A-11 43 112.

*Primary Examiner*—A. D. Pellinen
*Assistant Examiner*—Michael A. Friedhofer
*Attorney, Agent, or Firm*—Oblon, Spivak, McClelland, Maier & Neustadt

[57] ABSTRACT

A vacuum interrupter comprises a vacuum container which includes an insulation tube made of ceramics and having openings at both ends thereof, and sealing metals for hermetically sealing the openings respectively. In the vacuum container, a pair of contacts are disposed so that these contacts can detachably contact to each other. The composition of the material constituting at least one of the sealing metals comprises 25 to 55 wt % of Ni, 0.02 to 1.0 wt % of Si and substantially the residual amount of Cu. Preferably, the composition further comprises 0.02 to 1.5 wt % in total of Si and Mn and/or 5.0 wt % or less in total of Fe and Co.

4 Claims, 6 Drawing Sheets

FIG.2A

| | Composition of Alloys (wt%) | | | |
|---|---|---|---|---|
| | Ni | Cu | Si | Mn |
| Comparative Example 1 | 15.0 | Residual Content | 0.1 | 0.3 |
| Inventive Example 1 | 25.3 | Residual Content | 0.1 | 0.3 |
| Inventive Example 2 | 34.9 | Residual Content | 0.1 | 0.3 |
| Inventive Example 3 | 44.0 | Residual Content | 0.1 | 0.3 |
| Inventive Example 4 | 54.8 | Residual Content | 0.1 | 0.3 |
| Comparative Example 2 | 70.3 | Residual Content | 0.1 | 0.3 |
| | | | | |
| Comparative Example 3 | 45.3 | Residual Content | 0 | 0 |
| Comparative Example 4 | 47.6 | Residual Content | 0 | 0.02 |
| Inventive Example 5 | 46.6 | Residual Content | 0.02 | 0 |
| Inventive Example 6 | 46.5 | Residual Content | 0.03 | 0.02 |
| Inventive Example 7 | 47.1 | Residual Content | 0.11 | 1.1 |
| Inventive Example 8 | 46.3 | Residual Content | 0.02 | 1.4 |
| Inventive Example 9 | 44.8 | Residual Content | 0.48 | 0.97 |
| Inventive Example 10 | 47.8 | Residual Content | 1.0 | 0.48 |
| Comparative Example 5 | 44.1 | Residual Content | 1.3 | 0.18 |
| Comparative Example 6 | 45.9 | Residual Content | 0.52 | 1.4 |
| Comparative Example 7 | 48.1 | Residual Content | 0 | 2.0 |
| Comparative Example 8 | 44.5 | Residual Content | 1.0 | 0.9 |
| Comparative Example 9 | 46.2 | Residual Content | 0.02 | 2.1 |
| | | | | |
| Inventive Example 11 | 47.1 | Residual Content | 0.1 | 0.3 |
| Inventive Example 12 | 46.2 | Residual Content | 0.1 | 0.3 |
| Comparative Example 10 | 45.6 | Residual Content | 0.1 | 0.3 |
| | | | | |
| Inventive Example 13 | 46.2 | Residual Content | 0.1 | 0.3 |
| Inventive Example 14 | 45.2 | Residual Content | 0.1 | 0.3 |
| Inventive Example 15 | 46.8 | Residual Content | 0.1 | 0.3 |

FIG.2B

| | Composition of Alloys (wt%) | | |
|---|---|---|---|
| | Si+Mn | Fe | Co |
| Comparative Example 1 | 0.4 | 0 | 0 |
| Inventive Example 1 | 0.4 | 0 | 0 |
| Inventive Example 2 | 0.4 | 0 | 0 |
| Inventive Example 3 | 0.4 | 0 | 0 |
| Inventive Example 4 | 0.4 | 0 | 0 |
| Comparative Example 2 | 0.4 | 0 | 0 |
| | | | |
| Comparative Example 3 | 0 | 0 | 0 |
| Comparative Example 4 | 0.02 | 0 | 0 |
| Inventive Example 5 | 0.02 | 0 | 0 |
| Inventive Example 6 | 0.05 | 0 | 0 |
| Inventive Example 7 | 1.1 | 0 | 0 |
| Inventive Example 8 | 1.4 | 0 | 0 |
| Inventive Example 9 | 1.5 | 0 | 0 |
| Inventive Example 10 | 1.5 | 0 | 0 |
| Comparative Example 5 | 1.5 | 0 | 0 |
| Comparative Example 6 | 1.9 | 0 | 0 |
| Comparative Example 7 | 2.0 | 0 | 0 |
| Comparative Example 8 | 1.9 | 0 | 0 |
| Comparative Example 9 | 2.1 | 0 | 0 |
| | | | |
| Inventive Example 11 | 0.4 | 0.1 | 0 |
| Inventive Example 12 | 0.4 | 5.0 | 0 |
| Comparative Example 10 | 0.4 | 9.9 | 0 |
| | | | |
| Inventive Example 13 | 0.4 | 0 | 0.1 |
| Inventive Example 14 | 0.4 | 0 | 5.0 |
| Inventive Example 15 | 0.4 | 0.48 | 0.4 |

FIG.3A

FIG.3

FIG.3A

FIG.3B

| | Evaluation Results | | |
|---|---|---|---|
| | Corrosion Resistance | Anticorrosive Property in a Specific Atmosphere | Sealability |
| Comparative Example 1 | Green—colored over all the surface | —— | $1\times10^{-4}$ Pa or below over all the three test pieces |
| Inventive Example 1 | Green—colored at several points | —— | $1\times10^{-4}$ Pa or below over all the three test pieces |
| Inventive Example 2 | Green—colored at several points | —— | $1\times10^{-4}$ Pa or below over all the three test pieces |
| Inventive Example 3 | Green—colored at several points | 50 $\mu$m | $1\times10^{-4}$ Pa or below over all the three test pieces |
| Inventive Example 4 | Green—colored at several points | —— | $1\times10^{-4}$ Pa or below over all the three test pieces |
| Comparative Example 2 | Green—colored at several points | —— | $1\times10^{-4}$ Pa or below over all the three test pieces |
| | | | |
| Comparative Example 3 | Green—colored at several points | —— | Cracked on processing |
| Comparative Example 4 | Green—colored at several points | —— | $1\times10^{-2}$ Pa over all the three test pieces |
| Inventive Example 5 | Green—colored at several points | —— | $1\times10^{-4}$ Pa or below over all the three test pieces |
| Inventive Example 6 | Green—colored at several points | —— | $1\times10^{-4}$ Pa or below over all the three test pieces |
| Inventive Example 7 | Green—colored at several points | —— | $1\times10^{-4}$ Pa or below over all the three test pieces |
| Inventive Example 8 | Green—colored at several points | —— | $1\times10^{-4}$ Pa or below over all the three test pieces |
| Inventive Example 9 | Green—colored at several points | —— | $1\times10^{-4}$ Pa or below over all the three test pieces |

FIG.3B

| | | | |
|---|---|---|---|
| Inventive Example 10 | Green−colored at several points | —— | $1\times10^{-4}$ Pa or below over all the three test pieces |
| Comparative Example 5 | Green−colored at several points | —— | Returned to the atmospheric pressure over all the three test pieces |
| Comparative Example 6 | Green−colored at several points | —— | Cracked on cold processing |
| Comparative Example 7 | Green−colored at several points | —— | Cracked on cold processing |
| Comparative Example 8 | Green−colored at several points | —— | Cracked on cold processing |
| Comparative Example 9 | Green−colored at several points | —— | Cracked on cold processing |
| | | | |
| Inventive Example 11 | —— | 40 μm | $1\times10^{-4}$ Pa or below over all the three test pieces |
| Inventive Example 12 | —— | 30 μm | $1\times10^{-4}$ Pa or below over all the three test pieces |
| Comparative Example 10 | —— | 90 μm | $1\times10^{-4}$ Pa or below over all the three test pieces |
| | | | |
| Inventive Example 13 | —— | 40 μm | $1\times10^{-4}$ Pa or below over all the three test pieces |
| Inventive Example 14 | —— | 30 μm | $1\times10^{-4}$ Pa or below over all the three test pieces |
| Inventive Example 15 | —— | 40 μm | $1\times10^{-4}$ Pa or below over all the three test pieces |

FIG.4

| | Evaluation Results | | |
|---|---|---|---|
| | Temperature Increase | Noise | Total Evaluation |
| Comparative Example 1 | 40 | Not recognized | Bad |
| Inventive Example 1 | 45 | Not recognized | Good |
| Inventive Example 2 | 45 | Not recognized | Good |
| Inventive Example 3 | 45 | Not recognized | Good |
| Inventive Example 4 | 50 | Not recognized | Good |
| Comparative Example 2 | 75 | Recognized | Bad |
| | | | |
| Comparative Example 3 | — | — | Bad |
| Comparative Example 4 | 45 | Not recognized | Bad |
| Inventive Example 5 | 45 | Not recognized | Good |
| Inventive Example 6 | 45 | Not recognized | Good |
| Inventive Example 7 | 45 | Not recognized | Good |
| Inventive Example 8 | 45 | Not recognized | Good |
| Inventive Example 9 | 45 | Not recognized | Good |
| Inventive Example 10 | 45 | Not recognized | Good |
| Comparative Example 5 | 45 | Not recognized | Bad |
| Comparative Example 6 | — | — | Bad |
| Comparative Example 7 | — | — | Bad |
| Comparative Example 8 | — | — | Bad |
| Comparative Example 9 | — | — | Bad |
| | | | |
| Inventive Example 11 | 45 | Not recognized | Good |
| Inventive Example 12 | 45 | Not recognized | Good |
| Comparative Example 10 | 80 | Recognized | Bad |
| | | | |
| Inventive Example 13 | 45 | Not recognized | Good |
| Inventive Example 14 | 45 | Not recognized | Good |
| Inventive Example 15 | 45 | Not recognized | Good |

VACUUM INTERRUPTER

BACKGROUND OF THE INVENTION

The present invention relates to a vacuum interrupter applicable to use for switches employed in power plants, transformer substations and the like plants or stations.

Generally, vacuum interrupters are provided with an cylindrical insulation container made of alumina porcelain whose both end openings are sealed hermetically with sealing metals so as to allow the internal pressure to be reduced below $1\times10^{-2}$ Pa. In the vacuum container a pair of contacts (electrode) are disposed so that these electrodes contact detachably to each other. The surface of both end openings of the alumina porcelain is provided with a metallized layer formed through coat-baking a powder of Mo-Mn or the like material thereon so as to make possible brazing between the surface and the sealing metals, respectively. Incidentally, the seal-brazing between the insulation container and the sealing metals is carried out at a temperature of 780° to 1000° C. In addition, an corrosion resistance agent is coated over the sealing-metal surface.

As is well known, the vacuum interrupter is required to be highly reliable. In particular, since the interior of the interrupter on operation must be kept at a highly vacuum state for a long time, it is necessary to take much-care over the sealing portion. Namely, at the conjunction between the insulation container and sealing metals, two substances different in the thermal expansion coefficient contact with each other. Therefore, the difference between their thermal expansion coefficient to be generated on brazing in a high temperature range, such as 780° to 1000° C, causes internal stress which can not be ignored. Accordingly, amelioration of the internal stress is now considered as one of countermeasures to enhance the reliability of the vacuum interrupter.

To solve the problem, the material for constituting the sealing metal has been selected so far from alloys, such as 42Ni-Fe and 17Co-29Ni-Fe alloys, having a thermal expansion coefficient on brazing close to that of alumina porcelain.

However, the conventional vacuum interrupter mentioned above still includes inconveniences as described below.

First, the countermeasure to corrosion over the interrupter body, especially the corrosion resistance treatment on the surface of the sealing metals should be further improved. Namely, the material having been used for such a treatment is an organic resin or the like coating film. The coating film, however, is likely to be deteriorated with time in quality and strength or in coating ability. Therefore, it is difficult for the vacuum interrupter employing such an instable corrosion resistance coating to guarantee a desired long-term operational reliability. Especially, in chemical works or in environments near the see, it is almost impossible for the instable coating film to prevent corrosion by chlorine gas or the same ion and to realize a long-term reliability of the vacuum interrupter.

Secondly, since the sealing metal is a ferromagnetic substance, temperature increase is caused by iron loss due to the operating current. Moreover, noise is generated by the magnetostrictive vibration.

SUMMARY OF THE INVENTION

The present invention was made in the light-of the circumstances above, and therefore, it is an object of the present invention to provide a vacuum interrupter which is excellent in corrosion resistance and electric transmission efficiency, and which can prevent temperature increase during operation as well as can suppress noise generation.

To achieve the object above, one of the features of the present invention is a vacuum interrupter comprising:

a vacuum container which includes an insulation tube made of ceramics and having openings at both ends thereof, and sealing metals for hermetically sealing the openings respectively; and a pair of contacts which are disposed in the vacuum container so that these contacts can contact detachably to each other;

wherein the composition of the material constituting at least one of the sealing metals comprises 25 to 55 wt % of Ni, 0.02 to 1.0 wt % of Si and substantially the residual content of Cu.

Another feature of the present invention is a vacuum interrupter comprising:

a vacuum container which includes an insulation tube made of ceramics and having openings at both ends thereof, and sealing metals for hermetically sealing the openings respectively; and a pair of contacts which are disposed in the vacuum container so that these contacts can contact detachably to each other;

wherein the composition of the material constituting at least one of the sealing metals comprises 25 to 55 wt % of Ni, 0.02 to 1.0 wt % of Si, 5.0 wt % or less in total of Fe and Co, and substantially the residual content of Cu.

Still another feature of the present invention is a vacuum interrupter comprising:

a vacuum container which includes an insulation tube made of ceramics and having openings at both ends thereof, and sealing metals for hermetically sealing the openings respectively; and a pair of contacts which are disposed in the vacuum container so that these contacts can contact detachably to each other;

wherein the composition of the material constituting at least one of the sealing metals comprises 25 to 55 wt % of Ni, 0.02 to 1.0 wt % of Si, 0.02 to 1.5 wt % in total of Si and Mn, and substantially the residual content of Cu.

Still another feature of the present invention is a vacuum interrupter comprising:

a vacuum container which includes an insulation tube made of ceramics and having openings at both ends thereof, and sealing metals for hermetically sealing the openings respectively; and a pair of contacts which are disposed in the vacuum container so that these contacts can contact detachably to each other;

wherein the composition of the material constituting at least one of the sealing metals comprises 25 to 55 wt % of Ni, 0.02 to 1.0 wt % of Si, 0.02 to 1.5 wt % in total of Si and Mn, 5.0 wt % or less in total of Fe and Co, and substantially the residual content of Cu.

The most important point in the sealing material according to the present invention is that the material has an excellent corrosion resistance, and that it consists of a nonmagnetic substance. In view of the features, a non-magnetic Cu-Ni alloy was selected as the sealing material. As is well known, the Cu-Ni alloy generally has a larger thermal expansion coefficient than that of 42Ni-Fe or 17Co-29Ni-Fe alloy. However, the Cu-Ni alloy also presents smaller deforming stress at a high temperature than that of the Fe-base alloys. Therefore, the plastic deformation of the Cu-Ni alloy itself can absorb the stress to be caused by its thermal expansion on brazing.

Next, the components included in the Cu-Ni alloy will be considered in view of its brazing ability and processability.

Generally, Si and Mn are used as a deoxidizing agent. However, these components also play an important role for determining the sealability and reliability of the vacuum interrupter.

Namely, both Si and Mn have deoxidizing effect to the sealing alloy as well as have much influence on its processability, brazing ability and operation reliability.

As mentioned above, the vacuum interrupter according to the present invention must work to keep the vacuum container in a highly vacuum state on operation. Therefore, both a stable brazed state and possible deoxigenation are required to the sealing material.

Thus, the deoxidizing ability of Mn and Si is considered. If the oxygen content is controlled by addition of Mn only, it is necessary to use this component at a content higher than 1.5 wt %. However, if Mn is added at such a high content, the alloy is likely to get cracked if subjected to cold processing such as cold rolling.

In this case, if the content of Mn is limited to 1.5 wt % or less, and Si is added as an auxiliary deoxidizing agent at a content higher than 0.02 wt %, it becomes possible to carry out stable cold processing as well as to realize an allowable oxygen content. However, the cold processing is also affected by excessive addition of Si. Therefore, it is preferred to control the addition amount of Si and Mn at 1.5 wt % or less in total.

Since Si is more active than Mn, if the addition amount of Si exceeds 1.0 wt %, partial oxidation occurs in the surface of the Cu-Ni alloy. Therefore, it becomes difficult to carry out desired brazing in brazing operation in a vacuum atmosphere. Accordingly, it is necessary to limit the Si addition to 1.0 wt % or less.

Conversely, if the addition amount of Mn or Si is too small, incomplete structure including pinholes of massive organizations occurs in the brazing portion due to reaction of oxygen still remaining in the alloy. As a result, cracks are likely to occur during hot or cold processing. Therefore, to prevent these cracks, it is necessary to add at least 0.02 wt % of Si and Mn in total. However, adding only Mn at 0.02 wt % results in insufficient deoxygenation leading to pinholes or structural instability. Thus, it is necessary to further add at least 0.02 wt % of Si to the sealing alloy.

For the reason above, it is preferred to control the addition amount of Si in the range of 0.02 to 1.0 wt % while limiting the total addition amount of Si and Mn to the range of 0.02 to 1.5 wt %.

Moreover, we have discovered that adding Fe and Co to the Cu-Ni alloy further enhances its corrosion resistance property, thereby overcoming a severe environment in which reactive gases such as chlorine gas exist at a relatively large content. However, if the addition amount of Fe exceeds 5 wt %, the corrosion resistance property is degraded. On the other hand, if Co is added excessively, the Cu-Ni alloy tends to be ferromagnetic.

Accordingly, it is preferred to control the total addition amount of Fe and Co at 5 wt % or less.

Finally, the proportion of the main component Ni in the Cu-Ni alloy is considered.

The corrosion resistance is enhanced with increase of Ni. According to our study, sufficient anticorrosion against a natural environment of the like condition requires addition of at least 25 wt % of Ni. However, if the addition amount of Ni exceeds 55 wt %, the Cu-Ni alloy tends to be ferromagnetic in a low temperature range.

Accordingly, it is preferred to control the proportion of Ni in the range of 25 to 55 wt %.

These and other objects, features and advantages of the present invention will be more apparent from the following description of a preferred embodiment, taken in conjunction with the accompanying drawings.

BRIEF DESCRIPTION OF THE DRAWING

FIGS. 2A and 2B show proportions of components for constituting the materials of each sealing metals used in the embodiment in FIG. 1 and in other comparative examples, respectively;

FIG. 3A and 3B show data for comparing the corrosion resistance and sealability between the inventive examples according to the present invention and the comparative examples, respectively shown in FIGS. 2A and 2B;

FIG. 4 shows scores of temperature increase, noise and total evaluation on the materials of the sealing metals, respectively shown in FIGS. 2A and 2B.

DESCRIPTION OF THE PREFERRED EMBODIMENT

Figure 1:
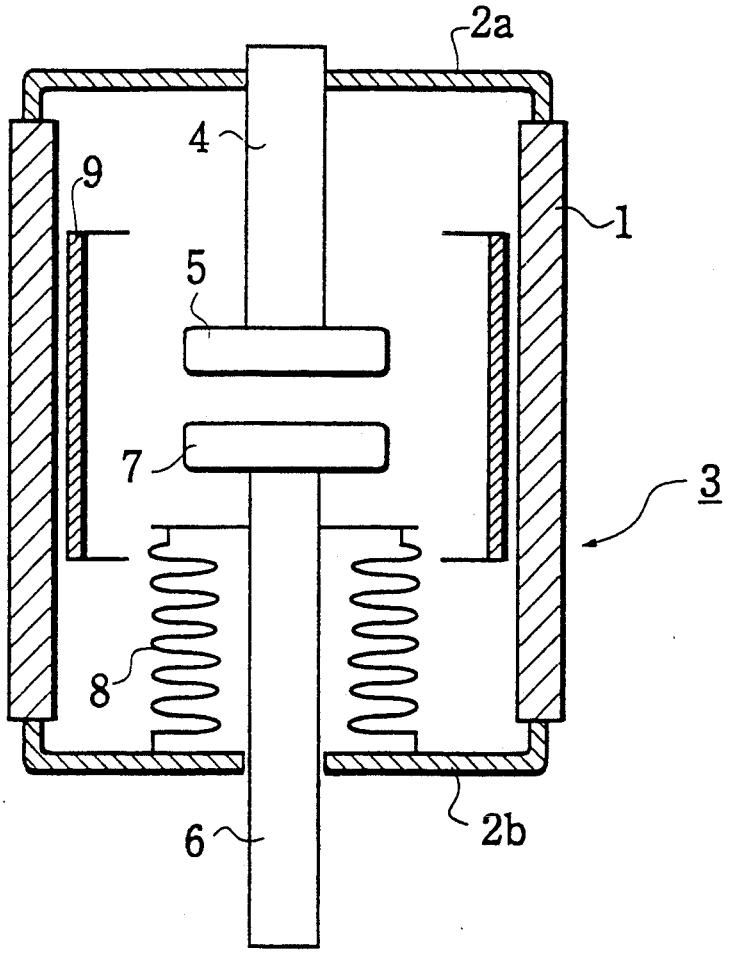
FIG. 1 shows a vertical cross section of an embodiment of a vacuum interrupter for carrying out the present invention.

Hereinafter, an embodiment of the present invention will be described in detail with reference to the drawings.

FIG. 1 shows construction of a vacuum interrupter. In the same drawing, an insulation tube 1 made of alumina porcelain has two end openings. One of the openings is sealed hermetically with a stationary-side sealing metal 2*a* and the other with a movable-side sealing metal 2*b*. In this manner, a vacuum container 3 is so constructed that the internal pressure can be reduced below $1\times10^{-2}$ Pa. In the vacuum container 3 a stationary contact 5 and a movable contact 7 are disposed respectively. The stationary contact 5 is secured to a stationary shaft 4 as a first current path. On the other hand, the movable contact 7 is secured to a movable 6 shaft as a second current path. Incidentally, the movable contact 7 is so designed as to move in the axial direction of the shaft 6 or 4 to optionally contact with the stationary contact 5. Moreover, a bellows 8 is secured to one end portion of the movable shaft 6 at one end thereof and to the movable-side sealing metal 2*b* at the other end thereof. The bellows 8 is so designed as to move for controlling the internal pressure of the vacuum container 3 at a constant value. In addition, a metal shield 9 is disposed in the vacuum container 3 so as to surround both the stationary and movable contacts 5 and 7. The aim of disposing the metal shield 9 is to absorb or catch metal vapor generated from both the contacts 5, 7 on contact or detachment therebetween. In this manner, reduction of insulation resistance due to the attachment of the metal vapor onto the internal wall of insulation tube 1 can be avoided.

Moreover, at least one of the sealing metals 2a, 2b contains 25 to 55 wt % of Ni, 0.02 to 1.5 wt % in total of Si and Mn, 5 wt % or less of Fe and substantially the residual content of Cu. In this case, the sealing metals 2a, 2b do not require a conventional coat film for preventing corrosion as mentioned above.

Since the sealing metals 2a, 2b contain the respective components at such a proportion as described above, it has a larger thermal expansion coefficient than that of the conventional 42Ni-Fe or the like alloy. Accordingly, the difference of expansion between the sealing metal and alumina porcelain constituting the insulation tube 1 becomes relatively large at a high temperature. However, the Cu-Ni sealing metal generally shows smaller deforming stress at a high temperature than that of such a Fe-base sealing alloy. Therefore, the plastic deformation of the Cu-Ni sealing metal itself can absorb the stress to be caused by its thermal expansion when the seal is brazed to each end opening of the insulation tube 1 at a temperature of 500° to 1000° C. Thus, the sealing metals 2a, 2b can present more excellent properties than those of 42Ni-Fe and 17Co-29Ni-Fe alloys.

Next, methods of testing various properties of respective alloys for producing the sealing metals are described.

(1) Corrosion resistance

The external appearance of each test piece was observed after spraying neutral salt water thereon for 720 hours. The size of the test piece was about 50 mm×50 mm×1 mmt.

(2) Corrosion resistance in a specific atmosphere

The so-called CASS test (Copper-accelerated Acetic acid Salt Spray test) more accelerated than the neutral salt water spray test was carried out. Namely, the CASS-test is a salt water spray test in an acidic atmosphere. Used for evaluating this property is a numeral value obtained by converting the reduction amount of the alloy due to the corrosion into an average reduced thickness. The time required for the test was 720 hours.

(3) Temperature property

A vacuum interrupter using the alloy as sealing metal according to the present invention was prepared. Then, temperature increase at the sealing metal was measured with a thermocouple while flowing an alternating current of 630A at 7.2KV for 3 hours.

(4) Noise in the ON state

At the same time as the measurement of the temperature property, the noise caused by magnetostrictive vibration was aurally evaluated.

(5) Sealability

As mentioned above, the sealability or sealing reliability must be considered most carefully on the seal connection between the Cu-Ni alloy and ceramics such as alumina porcelain. In particular, the brazed portion must keep hermetic seal even against impact caused by opening and closing operations. Thus, we evaluated the sealability in a manner as mentioned below.

First, a vacuum interrupter was prepared in the same manner as said above. Then, after controlling the internal pressure of the insulation container below $1\times10^{-4}$ Pa, the vacuum interrupter was attached to a predetermined switching device to repeat its opening and closing operations 1000 times with no load. Thereafter, the internal pressure was measured to evaluate the sealability of each sealing metal.

Incidentally, the number of vacuum interrupters used for each example was three.

Moreover, a typical method for preparing each material used for the inventive examples and comparative examples was carried out as described below.

Fe and Cu were added and mixed in melted Ni at $5\times10^{-3}$ Pa. Subsequently, an appropriate amount of Mn then Si were added to the admixture respectively. After cooling, the obtained ingot was subjected to hot forging at about 900° to 1000° C. and then to hot rolling at about the same temperature (900° to 10000° C.), thereby to obtain a rolled material. Thereafter, the material was processed by cold rolling at room temperature and annealing at a sufficiently high temperature for removing skewness caused by the cold rolling. These processes were repeated until the thickness of the material became a desired value.

Next, evaluations on the respective properties of the inventive examples and comparative examples are described with reference to FIGS. 2 to 4.

For convenience sake, the list of all components of each alloy is divided into FIGS. 2A and 2B.

Inventive Examples 1–4 and Comparative Examples 1–2

First, to consider the basic composition of the Cu-Ni alloy, six kinds of Cu-Ni alloys containing about 0.1 wt % of Si and about 0.3 wt % of Mn were respectively prepared. Moreover, these alloys contain Ni at 15.0, 25.3, 34.9, 44.0, 54.8 and 70.3 wt %, respectively. Incidentally, these contents of Ni correspond to Comparative Example 1, Inventive Examples 1 to 4 and Comparative Example 2, respectively.

FIGS. 3A, 3B and 4 show evaluation results on the respective properties as mentioned above of these test pieces, respectively.

With respect to the corrosion resistance based on the neutral salt water spray test, Comparative Example 1 containing 15 wt % of Ni changed into a green color over all the surface thereof. However, only several green-colored corroded spots were observed from the other Cu-Ni alloys containing Ni at 25.3 wt % or more.

Next, operating properties of respective interrupters including the sealing metal formed by each test piece described above were considered.

As is well understood from FIG. 4, small temperature increase and no noise generation were observed from each interrupter, on operation, including the Cu-Ni sealing metal containing Ni at 54.8 wt % or less. To the contrary, in case of the interrupter corresponding to Comparative Example 2 containing Ni at 70.3 wt %, distinct noise and remarkable temperature increase due to ferromagnetism of the alloy could be recognized. Incidentally, the sealability representing the brazing condition after the no-load switching operation test was allowable in any case.

Accordingly, from the results described above, it is preferred to use the Cu-Ni alloy having a basic composition comprising 25 to 55 wt % of Ni and substantially the residual content of Cu.

Inventive Examples 5-10 and Comparative Examples 3-9

Next, the addition amount of Si and Mn was considered.

In this case, we prepared thirteen kinds of Cu-Ni alloy test pieces having a basic composition comprising 45 wt % of Ni and also containing 0 to 1.3 wt % of Si and 0 to 2.1 wt % of Mn, the total amount of Si and Mn being 0 to 2.1 wt %. Incidentally, these test pieces correspond to Inventive Examples 5 to 10 and Comparative Examples 3 to 9, respectively.

In case of Comparative Example 3 containing no Si and Mn, a great amount of oxygen remained in the alloy. Thus, a great deal of cracks occurred on hot or cold processing so that we could not continue the preparation of the test piece. Though small cracks were also recognized on cold processing in Comparative Example 4 containing a small amount of Mn only, this case could provide the final test piece. However, the internal pressure of this case did not satisfy a practicable value after the no-load switching operation.

Inventive Examples 5 to 10 containing 0.02 to 1.0 wt % of Si and 0.02 to 1.5 wt % in total of Si and Mn presented good sealability, respectively.

On the other hand, in case of Comparative Example 5, though the total content of Si and Mn was lower than 1.5 wt %, the content of only Si was relatively high (1.3 wt %). In this case, the brazing could be completed while the internal pressure after the no-load switching operation returned to the atmospheric pressure.

Conversely, in any case of Comparative Examples 6 to 9 in which the total content of Si and Mn was higher than 1.5 wt %, remarkable cracks could be observed after the cold processing. Thus, we stopped the preparation of these samples.

Accordingly, it is preferred to control each addition amount of Si and Mn in the range of 0.02 to 1.0 wt % with proviso that the total amount of Si and Mn is in the range of 0.02 to 1.5 wt %.

Inventive Example 3, 11, 12 and Comparative Example 10

Next, the effect of Fe addition to the Cu-Ni alloy was considered.

As mentioned above, the Cu-Ni alloy generally shows a good corrosion resistance in such an atmosphere as defined by the neutral salt water spray test. However, in a severe atmosphere as defined by the CASS test, it presents corrosion which can be converted into weight or thickness.

Namely, as seen from Inventive Example 3, the 45Ni-Cu alloy presented a corrosion thickness of about 50 μm. However, if 0.1% of Fe-was further added as in Inventive Example 11, the corrosion thickness was reduced to 40 μm. Moreover, if the addition amount of Fe was further increased to 5% as in Inventive Example 12, the corrosion thickness was more decreased to 30 μm. However, if Fe was excessively added as in Comparative Example 10, the corrosion thickness was increased to 90 μm.

Accordingly, it is preferred to control the addition amount of Fe at 5% or less.

Modification

The same effect as in each Fe addition could be obtained by replacing a part or all of Fe with Co at an equal content. This case corresponds to Inventive Examples 13 to 15.

Various modifications will become possible for those skilled in the art after receiving the teachings of the present disclosure without departing from the scope thereof.

What is claimed is:

1. A vacuum interrupter comprising:

a vacuum container which includes an insulation tube made of ceramics and having openings at both ends thereof, and sealing metals for hermetically sealing said openings respectively; and a pair of contacts which are disposed in said vacuum container so that these contacts can contact detachably to each other;

wherein the composition of the material constituting at least one of said sealing metals comprises 25 to 55 wt % of Ni, 0.02 to 1.0 wt % of Si and substantially the residual content of Cu.

2. A vacuum interrupter comprising:

a vacuum container which includes an insulation tube made of ceramics and having openings at both ends thereof, and sealing metals for hermetically sealing said openings respectively; and a pair of contacts which are disposed in said vacuum container so that these contacts can contact detachably to each other;

wherein the composition of the material constituting at least one of said sealing metals comprises 25 to 55 wt % of Ni, 0.02 to 1.0 wt % of Si, 5.0 wt % or less in total of Fe and Co, and substantially the residual content of Cu.

3. A vacuum interrupter comprising:

a vacuum container which includes an insulation tube made of ceramics and having openings at both ends thereof, and sealing metals for hermetically sealing said openings respectively; and a pair of contacts which are disposed in said vacuum container so that these contacts can contact detachably to each other;

wherein the composition of the material constituting at least one of said sealing metals comprises 25 to 55 wt % of Ni, 0.02 to 1.0 wt % of Si, 0.02 to 1.5 wt % in total of Si and Mn, and substantially the residual content of Cu.

4. A vacuum interrupter comprising:

a vacuum container which includes an insulation tube made of ceramics and having openings at both ends thereof, and sealing metals for hermetically sealing said openings respectively; and a pair of contacts which are disposed in said vacuum container so that these contacts can contact detachably to each other;

wherein the composition of the material constituting at least one of said sealing metals comprises 25 to 55 wt % of Ni, 0.02 to 1.0 wt % of Si, 0.02 to 1.5 wt % in total of Si and Mn, 5.0 wt % or less in total of Fe and Co, and substantially the residual content of Cu.

* * * * *

UNITED STATES PATENT AND TRADEMARK OFFICE

CERTIFICATE OF CORRECTION

PATENT NO. : 5,294,761

DATED : March 15, 1994

INVENTOR(S) : Tsutomu OKUTOMI, et al.

It is certified that error appears in the above-indentified patent and that said Letters Patent is hereby corrected as shown below:

On the title page, Item [30], the Foreign Application Priority Date should read as follows:

--Nov. 22, 1991--

Signed and Sealed this

Fifth Day of July, 1994

*Attest:*

*Attesting Officer*

BRUCE LEHMAN

*Commissioner of Patents and Trademarks*